United States Patent [19]

Bach et al.

[11] Patent Number: 4,704,166

[45] Date of Patent: Nov. 3, 1987

[54] PROCESS FOR THE PRODUCTION OF MEDIUM CARBON STEEL WIRE ROD

[75] Inventors: Norbert Bach, Esch, Luxembourg; Marios Economopoulos, Liege, Belgium; Marc Gredt, Esch, Luxembourg; Guy Lessel, Esch, Luxembourg; Arthur Schummer, Esch, Luxembourg

[73] Assignee: Centre de Recherches Metallurgiques-Centrum Voor Research in de Metallurgie, Brussels, Belgium

[21] Appl. No.: 757,804

[22] Filed: Jul. 22, 1985

[30] Foreign Application Priority Data

Jul. 23, 1984 [LU] Luxembourg ..... 85475

[51] Int. Cl.[4] ..... C21D 9/52

[52] U.S. Cl. ..... 148/12 B; 148/156

[58] Field of Search ..... 148/12 B, 12.4, 153, 148/155, 156

[56] References Cited

U.S. PATENT DOCUMENTS

| | | | |
|---|---|---|---|
| 3,645,805 | 2/1972 | Hoffman et al. | 148/156 |
| 3,666,572 | 5/1972 | Nakagawa et al. | 148/12 B |
| 3,783,043 | 1/1974 | Almond et al. | 148/12 B |
| 4,395,022 | 7/1983 | Paulus et al. | 266/106 |

FOREIGN PATENT DOCUMENTS

| | | | |
|---|---|---|---|
| 164731 | 1/1983 | Japan | 148/12 B |

*Primary Examiner*—Christopher W. Brody
*Attorney, Agent, or Firm*—Holman & Stern

[57] ABSTRACT

In the production of medium carbon steel wire rod, upon leaving the hot rolling mill, the rod is cooled in two phases. The first phase is operative as the rod moves at end-of-rolling speed along a cooling line disposed between the finishing block and feed rollers disposed at the entry of a head for placing the rod in overlapping turns on a conveyor, the cooling line being continuous—i.e. being devoid of air cooling breaks between consecutive intensive cooling sections, the length and capacity of the cooling line being such that the surface temperature of the rod at the end of the first phase is between, on the one hand, the start-of-martensitic-transformation temperature for the particular steel concerned and, on the other hand, the latter temperature plus 200° C. The second cooling phase is operative upon the rod once it has been placed in overlapping non-concentric turns on the conveyor, the time which elapses between the end of the first phase and the start of the second phase being less than the time needed for the percentage of transformed austenite to exceed 5%. Austenite transformation is at least 95% at the departure from the second phase.

8 Claims, 4 Drawing Figures

PROCESS FOR THE PRODUCTION OF MEDIUM CARBON STEEL WIRE ROD

This invention relates to a process for the production of medium carbon steel wire rod—i.e., wire rod made of a steel having a carbon content >0.4%—the process according to the invention comprising an original heat treatment phase to which the rod is subjected upon leaving the hot mill.

The process according to the invention gives wire rod mechanical properties and homogeneity equivalent to those obtained by lead patenting.

Another advantage of the process according to the invention is to obviate the disadvantages arising from central segregation caused by continuous steel casting; central segregation is a particular nuisance when the wire rods are to be used after drawing as prestressed concrete reinforcement, for since the average carbon content may rise to 0.8% in such a case the carbon content of the segregated zones may exceed 1.1%, in which event normal cooling on modern mill trains leads to a cementite precipitation impairing drawability.

Of course the final properties of a wire depend mainly upon the state of the wire before the final cold shaping operations such as drawing are started. Actually, of course, to obtain the ideal structure for drawing the start-of-allotropic-transformation temperature must be lowered and recalescence arising from the allotropic transformation must be limited. The conventional treatment for this purpose is to treat the wire by lead patenting.

Lead patenting and appropriate cold drawing can provide wires, even wires of very reduced diameter, having the required final mechanical properties.

The main disadvantage of such processes is that lead patenting and possible lead pre-patenting are very expensive operations both in themselves and also because of the manipulations and of the loss of productivity they cause in a drawing mill.

Various processes have been devised to obviate these disadvantages but broadly speaking either do not provide a product having properties comparable with the properties of lead patented wires or suffer from operating disadvantages preventing their use in industry.

The methods proposed to achieve the object aimed at—i.e., elimination of hot patenting in hot rolling—can be placed in two categories according as the controlled cooling is applied on line before the formation of turns or on the conveyor on which wire rod is placed in overlapping turns.

With regard to treatment by the water cooling ramp or battery before the facility for forming the turns of rod, the problem which usually arises is that the time available to use the suggested means is very short, for example, of the order of half a second in rolling mills having a high exit speed, and so very intensive cooling must be used to reduce temperature in such lines, with the result that substantial heat gradients are produced in the rod cross-section and there is a risk of the surface formation of martensite.

Of the various technical solutions proposed to solve this problem there are two which are particularly noteworthy. In the first, the rod is cooled to below 600° C. by going through water-cooling boxes or chests separated from one another by air break sections permitting a rise in the temperature of the rod surface, the complete installation being calculated to provide the required reduction of the average temperature of the rod while obviating the formation of martensite on the rod surface.

This process has not yet been used widely in industry because there are a number of difficulties in applying it. For instance, a number of water chests are needed and chest length must decrease rapidly in the direction of rod advance; also, since the water must be stopped at the exit of each chest so that the surface can be reheated, spray breakers are necessary but they are difficult to use and inefficient. Also, the optimal configuration of such a cooling installation depends upon the diameter of the rod, its carbon content and the required properties, and so even if an optimal ramp or battery could be constructed in practice, it would be of use only for one grade and one diameter of rod. Since most modern rod trains roll a very wide range of products, the installation would therefore not have the required optimal characteristics. To obviate these disadvantages, the ramp could be so constructed that the surface temperature of the rod would be considerably above the Ms point for all diameters and all grades of the product range; in that case, however, the length of the cooling ramp would be very substantially greater than its maximum practical value, leading to very high first costs and to difficulties in operating the train.

In the second system mentioned, the rod is also cooled before being placed on the conveyor but in this case with the formation of a very thin surface layer of martensite. This process reduces cooling line length and obviates the disadvantage of an installation having various cooling boxes separated by air break cooling zones but still does not solve the other problems mentioned—i.e. the difficulty of adapting the ramp to the entire range of products being made; also, the process introduces an additional disadvantage after the heat treatment because the recalescence which must be inhibited when the rod is spread on the conveyor is greater in proportion as the start-of-transformation temperature has been lowered.

Turning now to the second set of solutions residing in giving the treatment when the wire rod is disposed in non-concentric turns on a conveyor, it is seen that of the processes so far suggested, some increase cooling effectiveness by an appropriate choice of the fluid used while others deal with recalescence at the place where it occurs.

Of the various processes there may be mentioned those in which cooling is by air being blown or aspirated through the turns of wire rod. These processes definitely provide a considerable improvement in the average value of rod properties and in the dispersion of measurements around the average while also improving the structure sufficiently to obviate the need for pre-patenting. In the case of wire rod, however, final lead patenting is still necessary.

Similarly, it has been proposed to treat wire rod arranged in overlapping turns in a fluidized bed. This step provides a further improvement on what has just been described but suffers from other mainly technological difficulties.

Cooling the wire by immersion in a molten salt bath or in a concentrated aqueous solution also has disadvantages of its own including the need for subsequent washing of the rod and for the use of very special installations.

In short, the prior art provides no satisfactory solution of the problem—i.e., to provide a good average value of the properties of a rod in each reel of such rod and a reduced dispersion of the rod properties around the average. The reason, except for air blowing, is that the processes considered are often impossible to use for economic and/or technical reasons.

The other processes asssociated with rod disposed in non-concentric turns on a conveyor have as their object to eliminate recalescence by accelerating the cooling in that part of the conveyor where the recalescence occurs. Various kinds of cooling have been recommended, such as water mist, spraying, immersion in a bath and so on, yet none of the proposed processes has been used industrially since it has proved impossible in practice to give a selective cooling which is both intensive and homogeneous at the particular place where the recalescence occurs.

This invention relates precisely to a process for the production of medium carbon steel wire rod, the resulting rod having mechanical properties similar to those provided by the additional step of lead patenting while the dispersion of properties around the average in a coil is so reduced that the properties can be considered to be homogeneous.

In the process according to this invention, upon leaving the hot mill the rod is cooled in two phases, the first phase being operative as the rod moves at the end-of-rolling speed along a cooling line disposed between the finishing block and the feed rollers disposed at the entry of the head for placing the rod in overlapping turns on a conveyor, the cooling line being continuous—i.e., being devoid of air cooling breaks between consecutive intensive cooling sections—the length and capacity of the cooling line being such that the surface temperature of the rod at the end of the first phase is between, on the one hand, the start-of-martensitic-transformation temperature for the particular steel concerned, and, on the other hand, the latter temperature plus 200° C.; the second cooling phase is operative upon the rod once it has been placed in overlapping non-concentric turns on the conveyor, the time which elapses between the end of the first phase and the start of the second phase being less than the time needed for the percentage of transformed austenite to exceed 5%; and austenite transformation is at least 95% at the departure from the second phase.

In a preferred embodiment of the process according to the invention, the first cooling is given by means of a fluid applied by facilities adapted to provide a cooling intensity having a mean heat flow density of from 3 to 7 $MW/m^2$.

In one particular embodiment of the process according to the invention, the cooling intensity in the second phase is from 0.1 to 0.4 $MW/m^2$.

According to the invention, cooling of the rod on the conveyor in the second heat treatment phase can be either by air blowing or by immersion in boiling water or by any other means.

The value aimed at for the surface temperature Ts at the exit from the first phase is obtained according to the invention by choosing an appropriate combination between the values for cooling line length (or duration) L and the average heat flow density $\phi$.

The coordinates ($\phi$–L) selected in accordance with the process are such that the required mechanical properties are obtained after the second-phase treatment. The required breaking load TS will be near the value given by the formula:

$$TS=(C\ \%) \cdot 1000+500\ (N/mm^2)$$

BRIEF DESCRIPTION OF THE DRAWINGS

FIG. 1 shows the cooling curves at the surface I and at the centre II of a 12 mm diameter wire which is made of steel containing 0.63% C and 0.65% Mn and which has been treated by the process according to the invention in the following conditions:

end-of-rolling speed V: 22.88m/s
length of ramp or battery installed in the block, $L_1$: 4 m
length of main water-cooling ramp, $L_2$: 39.13 m
average heat flow density in the first phase $\phi$: 3.58 $MW/m^2$
coefficient of heat exchange in the cooling facility in the second phase : 0.27 $kW/m^2$ ° C.
surface MTT: 601° C.
centre MTT: 626° C.
$\overline{MTT}$: 606° C.

At a and a′ the quantity of austenite transformed is 2%, as compared with 98% at b and b′—i.e. at the end of the second phase.

Figure 1:
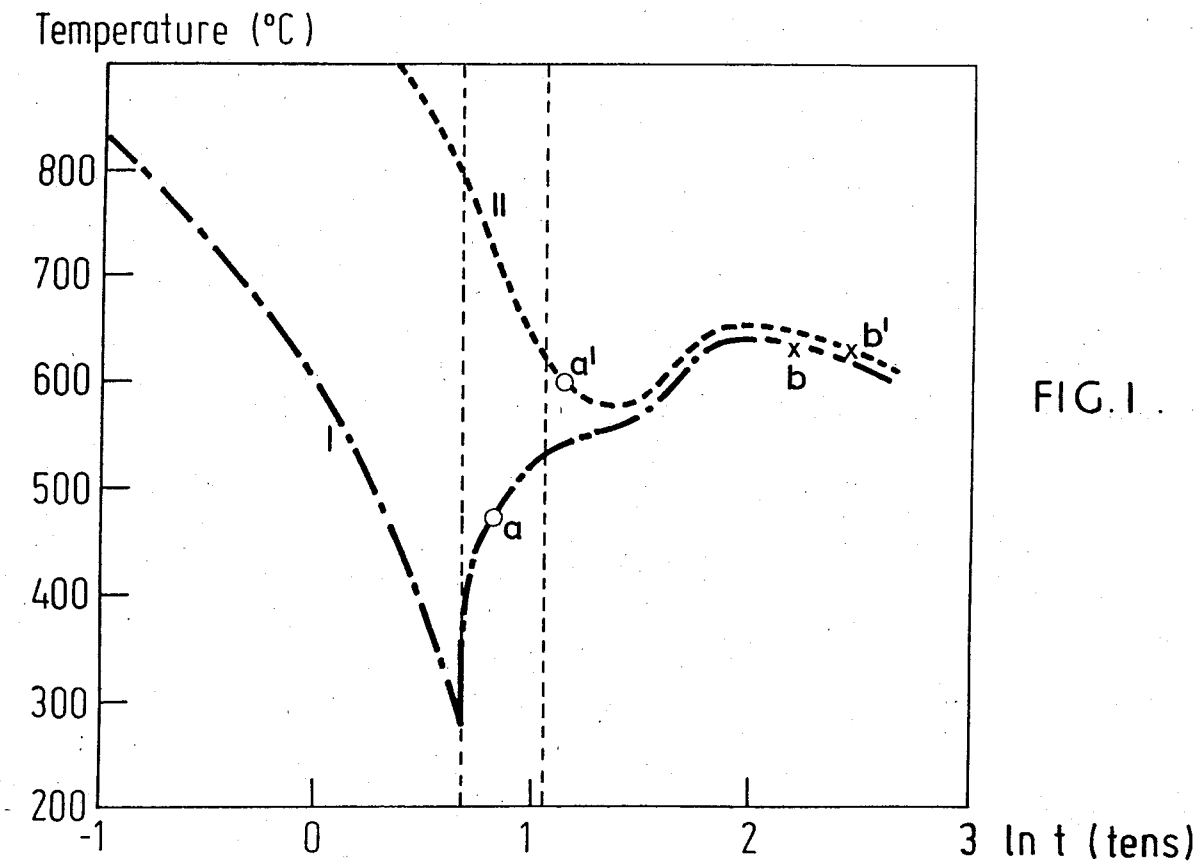
FIG. 1 is a graph of the temperature at the surface and the center of a 12 millimeter diameter wire rod during cooling plotted against time on a logarithmic scale.

FIG. 1 also shows that the second object of the invention—i.e., elimination of the pre-eutectoid cementite in the core of the segregated rods—arises automatically by the use of the process since the start-of-transformation temperature of the core is reduced below 600° C., thus obviating precipitation of the pro-eutectoid cementite.

As a practical example of the process according to the invention consideration will be given hereinafter to its use in a new rolling mill where it is required to determine the necessary distance between the exit of the block and the feeder rolls; Table I hereinafter gives the main particulars of the installation an of the products while FIG. 2 diagrammatically illustrates the equipment layout.

Figure 2:
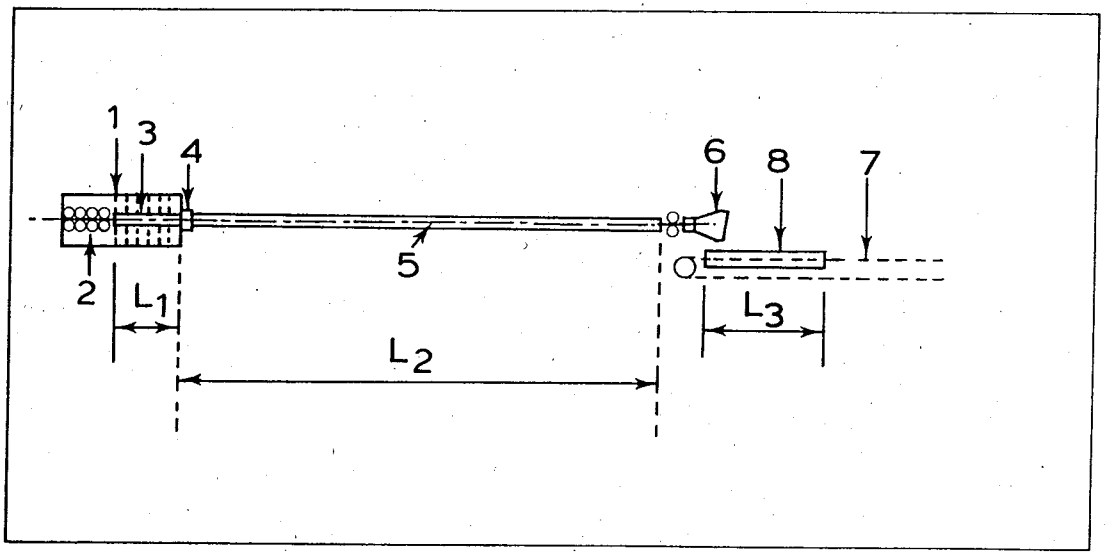
FIG. 2 is a schematic elevation of a wire rod rolling and cooling installation.

Referring to FIG. 2, there can be seen a finishing block 1 comprising after roll stands 2 a cooling line 3 of length $L_1$ disposed instead of unused roll stands, a break-out box 4, a continuous cooling line 5 of length $L_2$, a head 6 for forming the wire rod into turns and placing them on a conveyor 7, the same having a cooling facility 8 of a length $L_3$ for the second treatment phase.

TABLE I

| Particulars | Example | | | |
|---|---|---|---|---|
| No. of roll stands in finishing block | 10 | | | |
| Between-axis distance of block stands | 750 mm | | | |
| Diameter range | 5.5 to 12 mm | | | |
| End-of-rolling temperature, max. | 1050° C. | | | |
| Per diameter: | Dia. | V | $L_1$ | p |
| V = end-of-rolling speed (m/s) | 5.5 | 85 | 0 | 15.9 |
| $L_1$ = length of ramp installable | 7 | 82.8 | 1 | 25 |
| in block (see below) | 8 | 63.4 | 1 | 25 |

TABLE I-continued

| | | | | | |
|---|---|---|---|---|---|
| (in meters) | | | | | |
| p = instantaneous mass flow of steel (kg/s) | | 10 . 12 | 40.5 28.2 | 2.5 4 | 25 25 |
| Max. C content | for the application of the process | 0.8% | | | |
| Min. C content | | 0.6% | | | |
| Length of break-out box | | 1400 mm | | | |
| Distance travelled by rod between exit from water ramp and entry into forced cooling on conveyor | | 20 m | | | |
| Length of main water-cooling ramp | | $L_2$ | | | |
| Intended breaking load (MPa) | | $T_s$ = (C %) · 1000 + 500 | | | |
| Coefficient of heat exchange in the accelerated cooling facility on the conveyor | | 0.27 kW/m2° C. | | | |
| Density of turns on the conveyor | | 25 turns/m | | | |
| Maximum conveyor speed | | 1 m/s | | | |
| Average diameter of turns | | 1050 mm | | | |

The following comments can be made on the basis of this use in special conditions:

To minimize the size of the installation a cooling section of length $L_1$ was installed instead of the unused roll stands; $L_1$ is therefore a function of diameter.

It is assumed that the rod is not cooled in the break-out box. However, since the box is so short, the interruption of cooling has no metallurgical effect and the cooling ramp behaves like a continuous ramp of length $L_1+L_2$.

The dwell of the wire in air between the two phases of accelerated cooling must be minimal; however, for technological reasons, such as feed rollers, rod-laying head, dropping of turns and so on, it cannot be zero and the minimum dwell of the rod in air has been assumed to correspond to a straight path of 20 m.

It is assumed that the first-phase cooling facility has a constant heat flow density value $\phi$. Consequently, the coefficient of exchange used for calculations will be:

$$\alpha = \frac{\phi}{T_s - T_m}$$

where $T_s$ is the surface temperature and $T_m$ is the temperature of the cooling fluid.

It has been found that this hypothesis correlates reasonably with experiences at least for values of $T_s$ above 350°–400° C.

For the second-phase cooling a Newtonian cooling in which $\alpha$=const. is assumed and differences of cooling intensity between the centres and the nodes of the sheet of turns are neglected. This hypothesis is very close to the facts in the case in which cooling is by immersion of turns in boilng water. However, the conclusions remain valid in a first approximation in the case in which the second-phase cooling is by air blowing.

The problem is to determine:

the minimum value of $L_2$ at which the process can be applied to the whole product mix (Table I);

the value of $\phi$ for each diameter and each carbon content of the product mix;

the minimal treatment length $L_3$ in the second phase.

(a) Length $L_2$

The calculating procedure used is the following:

For a given diameter the most difficult case is considered, corresponding to:

the maximum temperature of placing on the conveyor (1050° C. in the example);

the minimum C content (0.6% in the example) for the point $M_s$ is highest for the minimum % C value and so the minimum surface temperature which can be reached in the first phase is the highest one.

The relationship between $T_S$ and the main transformation temperature (MTT) is known, the latter being defined at a point considered as the mean of the curve T=f(z) giving at such point the variation of the temperature T and the percentage of transformed austenite z:

$$MTT = \int_0^1 f(z)dz$$

Clearly, the MTT is a function of the point considered in the cross-section and, assuming cylindrical symmetry, the MTT can be regarded as constant along a circle of radius r disposed in the rod cross-section—i.e., MTT=MTT (r); also, it is found by experience that the breaking load is a linear function of the MTT—i.e., y=a MTT+b.

It has also been found by experience that in a wire of radius R in which the MTT varies with r (so that y=y (r)), the rule of additivity can be aplied to discover the macroscopic breaking load of the rod:

$$TS = \frac{1}{R^2} \int_0^R 2rdry(r);$$

by making $x=r^2$ and replacing y by its value as a function of the MTT:

$$TS = \frac{1}{R^2} \int_0^{R^2} MTT(x)dx + b$$

from which:

$$T_s = a\overline{MTT} + b$$

with $$MTT = \frac{1}{R^2} \int_0^{R^2} y(x)dx.$$

This final equation defines MTT for the whole of the wire cross-section.

The last two equations show that MTT is the constant MTT value in the cross-section which would give the macroscopic value of TS of the breaking load of the rod.

The foregoing shows that the required value can therefore be calculated for MTT (called MTT*). In the example chosen MTT*=606° C.

If the value of $L_2$ is selected arbitrarily, just a single value of $\phi$ giving at the end of the transformation—i.e., after the second phase—MTT=MTT* corresponds to the arbitrary value of $L_2$.

Figure 3:
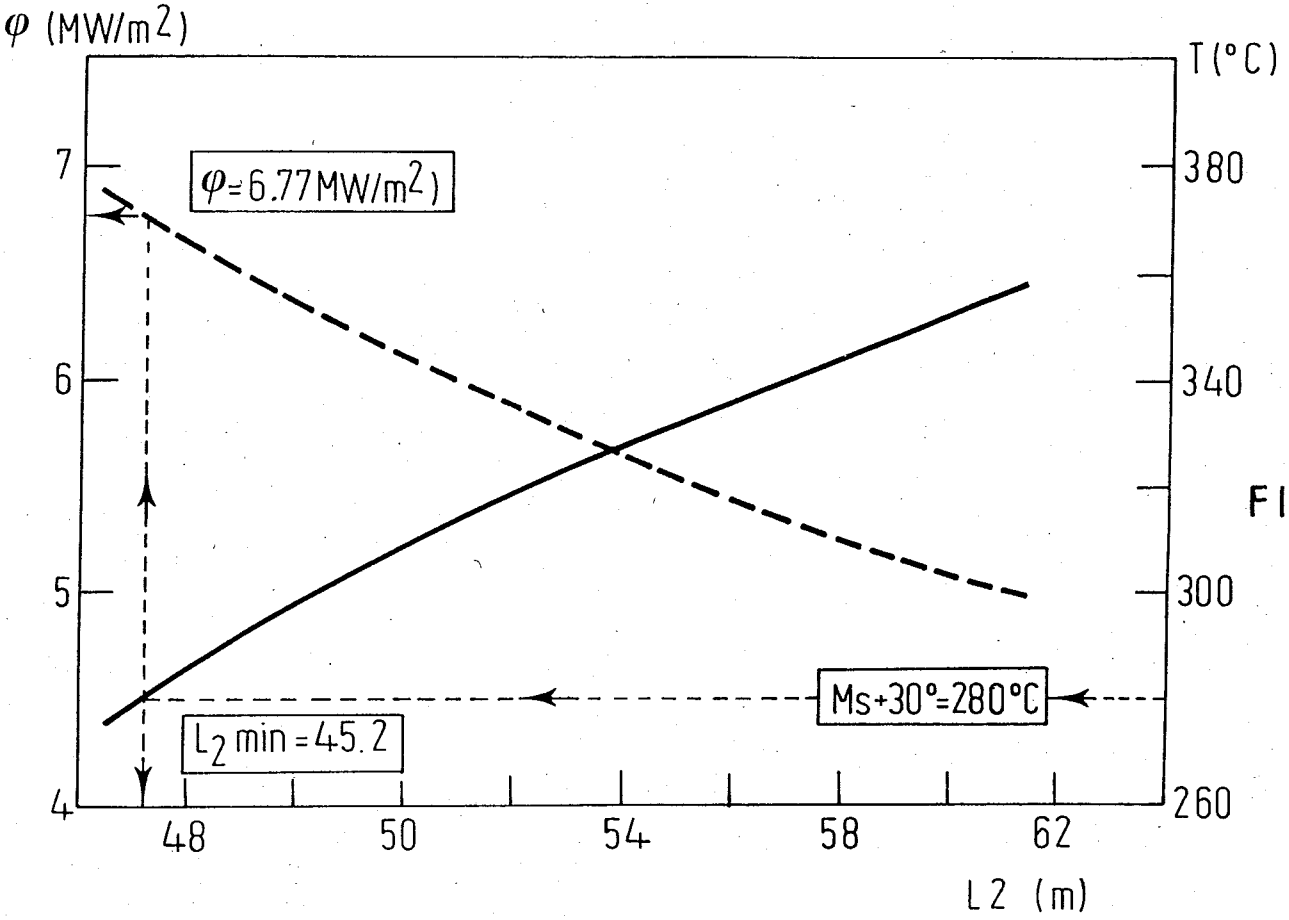
FIG. 3 is a graph of heat flux and rod surface temperature plotted against the length of the main water cooling ramp.

FIG. 3 shows the set of co-ordinates ($L_2$, $\phi$) for making MTT* for the case of producing a 7 mm diameter wire which is made of steel with a 0.63% C and 0.65% Mn content and which is rolled at an end-of-rolling temperature, $T_0$, of 1050° C. and which has an exit speed V of 82.8 m/s, the length $L_1$ of ramp in the block being 1 m. FIG. 3 also gives for each pair ($L_2$, $\phi$) the value of the minimum surface temperature T during the first phase. Clearly, the necessary length $L_2$ increases in proportion as the minimum assumed surface temperature is higher.

The minimum assumed surface temperature depends upon the quality of the train control system.

Figure 4:
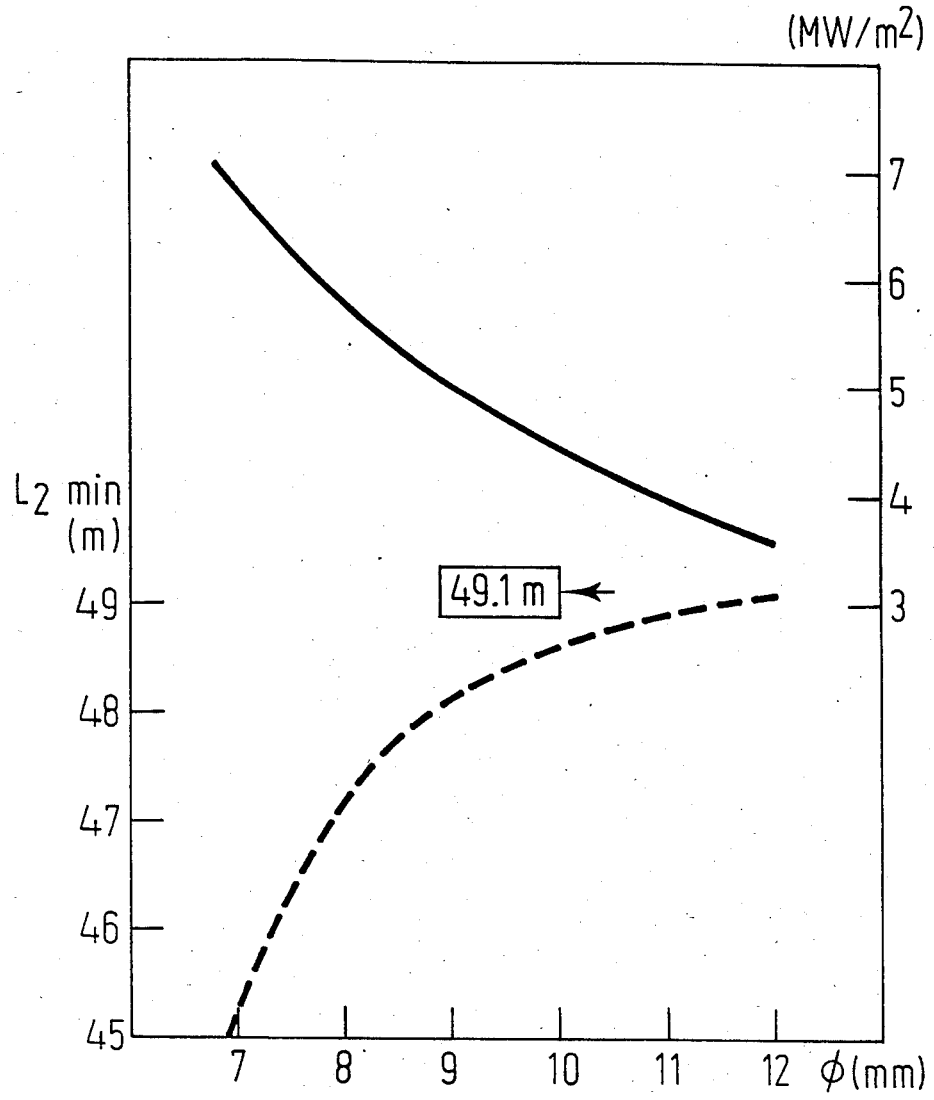
FIG. 4 is a graph of the minimum length of the main water cooling ramp and the heat flux plotted against the rod diameter.

For accurate computer control and by means of the single highly governable ramp, a minimum surface temperature, for example, of $M_s+30°$ C. can be assumed. FIG. 3 then makes it possible to find $L_2$ min and the corresponding $\phi$ for the diameter of 7 mm—i.e., in the event $L_2$ min=45.2 m and $\phi=6.77$ MW/m$^2$. By repeating the same procedure for all the rolled diameters the variation of $L_2$ min with diameter is prepared (FIG. 4). The greatest value of $L_2$ min corresponds to the diameter of 12 mm for the example selected and this is the value chosen for $L_2$(49.1 m). FIG. 4 also gives the variation of $\phi$ in dependence on the diameter be rolled.

(b) Calculation of $\phi$

Once $L_2$ is known, the values of $\phi$ and of the minimum surface temperature can be calculated for the other diameters:

| Diameter (mm) | 5.5 | 7 | 8 | 10 | 12 |
|---|---|---|---|---|---|
| $\phi$ (MW/m$^2$) | 5.02 | 6.23 | 5.52 | 4.36 | 3.58 |
| $T_S$ min - MS | 169 | 54 | 42 | 33.4 | 30 |
| V (m/s) | 85 | 82.8 | 63.4 | 40.5 | 28.2 |
| Mass flow instant. (T/h) | 57.2 | 90 | 90 | 90 | 90 |
| $L_1$ (m) | 0 | 1 | 1 | 2.5 | 4 |

$L_2$ = 49.1 m; T° = 1050° C.; 0.63% C–0.65% Mn – $\overline{MTT}$* = 606°

Reliability in relation to $M_s$ increases in proportion as diameter decreases and becomes considerable at the diameter of 5.5 mm since for this diameter the instantaneous mass flow of the train is reduced.

Also, to apply the process according to the invention in the conditions of the example the same installation must be capable of producing flows of from 3.5 to 6.5 MW/m$^2$.

The foregoing calculations can be made for wires having a higher carbon content with completely comparable results except as regards the reliability of $M_s$ which will be greater.

(c) Determination of $L_3$

The following Table gives for a turns density of 25 m the conveyor speed, the treatment time necessary for transformation to terminate at 98% and the corresponding length $L_3$:

| Diameter (mm) | 5.5 | 7 | 8 | 10 | 12 |
|---|---|---|---|---|---|
| Conveyor speed (m/s) | 1.03 | 1.0 | 0.77 | 0.49 | 0.34 |
| Treatment time (s) | 6.26 | 6.99 | 7.34 | 8.14 | 9.04 |
| $L_3$ (m) | 6.46 | 6.99 | 5.65 | 4.00 | 3.09 |

The greatest of the calculated values—i.e., 7 m—is retained for $L_3$. If the second-phase cooling is by air blowing, allowance must be made for cooling of the nodes to be considerably slower.

The technology used to apply the process according to the invention is as a whole known.

In the first phase, for example, conventional water guns are used and $\phi$ is adjusted by acting on the gun supply pressure. Water-air guns can also be used, in which case control is by way of the rate of air flow.

We claim:

1. A process for the production of medium carbon steel wire rod, using a continuous cooling line disposed between the finishing block of a hot rolling mill and the feed rollers disposed at the entry of a head for placing the wire rod in overlapping turns on a conveyor, the cooling line being devoid of air cooling breaks between consecutive intensive cooling sections, the process comprising a first cooling phase which consists in rapidly cooling the wire rod while moving at rolling speed along said continuous line to a surface temperature between start-of-martensitic-transformation-temperature (Ms) and (Ms+200° C.), adjusting the length and the cooling capacity of the cooling line so that said surface temperature is reached at the end of said first phase, a step of placing the wire rod in overlapping turns on the conveyor, and a second cooling phase consisting in cooling the wire rod while being in overlapping turns on the conveyor at a rate lower than that of said first phase, during a time sufficient for having at least 95% of the austenite transformed to pearlite at the end of the second phase, the time lapse between the end of the first cooling phase and the beginning of the second cooling phase being such that a maximum of 5% of austenite has transformed to pearlite when the second cooling phase begins.

2. A process for the production of a medium carbon steel wire rod having a pearlitic structure by lowering the temperature of start of th allotropic transformation in said wire rod, comprising successively subjecting said wire rod upon leaving the hot rolling mill to a first step which consists in rapidly cooling the surface of said wire rod from the end of rolling temperature to a temperature comprised between the start of martensitic transformation temperature (Ms) of the steel concerned and (Ms+200° C.), placing the wire rod in loose turns on a conveyor within a time lapse which is less than the time needed for the percentage of transformed austenite to exceed 5%, and subjecting the wire rod on the conveyor to a second cooling step which causes the amount of transformed austenite to be at least 95% at the end of said second step.

3. The process of claim 2, in which the first cooling is given by means of a fluid applied by facilities adapted to provide a cooling intensity having a mean heat flow density of from 3 to 7 MW/m$^2$.

4. The process of claim 2, in which the cooling intensity in the second phase is from 0.1 to 0.4 MW/m$^2$.

5. The process of claim 2, in which cooling of the wire on the conveyor in the phase is by immersion in boiling water.

6. A process as claimed in claim 2, wherein said first step is operative as the wire rod moves at end of rolling speed along a cooling line disposed between the finishing strands of the hot rolling mill and the head for placing the wire rod in loose turns on the conveyor.

7. A process as claimed in claim 6, wherein the surface temperature of the wire rod is controlled by adjusting the length and the capacity of said cooling line.

8. A process as claimed in claim 2, wherein the said temperature of start of the allotropic transformation is lowered below 600° C.

* * * * *

UNITED STATES PATENT AND TRADEMARK OFFICE

CERTIFICATE OF CORRECTION

PATENT NO. : 4,704,166

DATED : November 03, 1987

INVENTOR(S) : Norbert Bach, et al.

It is certified that error appears in the above-identified patent and that said Letters Patent is hereby corrected as shown below:

Column 1, Line 73, Assignee, should read -- Centre de Recherches Metallurgiques-Centrum Voor Research in de Metallurgie, Brussels, Belgium and Arbed S.A., Luxembourg --

Signed and Sealed this

Second Day of August, 1988

*Attest:*

*Attesting Officer*

DONALD J. QUIGG

*Commissioner of Patents and Trademarks*